US006848473B2

(12) United States Patent
Fiala et al.

(10) Patent No.: US 6,848,473 B2
(45) Date of Patent: Feb. 1, 2005

(54) LOW LEAK BOOM CONTROL CHECK VALVE INCLUDING AN INSERT

(75) Inventors: George T. Fiala, Racine, WI (US); David W. Swaim, Joliet, IL (US)

(73) Assignee: CNH America LLC, New Holland, PA (US)

( * ) Notice: Subject to any disclaimer, the term of this patent is extended or adjusted under 35 U.S.C. 154(b) by 0 days.

(21) Appl. No.: 10/718,941

(22) Filed: Nov. 21, 2003

(65) Prior Publication Data

US 2004/0103945 A1 Jun. 3, 2004

Related U.S. Application Data

(62) Division of application No. 10/425,481, filed on Apr. 29, 2003, now Pat. No. 6,779,542, which is a division of application No. 09/981,103, filed on Oct. 17, 2001, now Pat. No. 6,581,639.

(60) Provisional application No. 60/241,911, filed on Oct. 20, 2000.

(51) Int. Cl.[7] ..... F15B 13/04

(52) U.S. Cl. ..... 137/596.2; 91/436; 91/447; 91/451

(58) Field of Search ..... 91/436, 447, 451; 137/596.2

(56) References Cited

U.S. PATENT DOCUMENTS

| | | | | |
|---|---|---|---|---|
| 3,506,031 | A | 4/1970 | Stacey | 137/596.2 |
| 3,978,879 | A | 9/1976 | Termansen et al. | |
| 4,958,553 | A | 9/1990 | Ueno | |
| 5,778,932 | A | 7/1998 | Alexander | |
| 5,921,165 | A | 7/1999 | Takahashi et al. | |
| 6,581,639 | B2 | 6/2003 | Fiala et al. | |

*Primary Examiner*—Gerald A. Michalsky
(74) *Attorney, Agent, or Firm*—Collin A. Webb; John William Stader

(57) ABSTRACT

An insert or cartridge that fits into a cavity in a valve body provides a check valve function and an anti-cavitation function and a pressure relief function. This insert is substantially circular and has an internal cavity with a valve assembly that has two pairs of valve seats, one pair of valve seats providing the anti-cavitation function and the other pair of valve seats providing the pressure relief function. The outside of the insert itself engages with a sealing surface in the cavity in the valve body to provide the check valve function.

5 Claims, 6 Drawing Sheets

LOW LEAK BOOM CONTROL CHECK VALVE INCLUDING AN INSERT

CROSS-REFERENCE TO RELATED PATENT APPLICATIONS

This divisional patent application claims priority under 35 U.S.C. § 120 from U.S. patent application Ser. No. 10/425,481 filed on Apr. 29, 2003, now U.S. Pat. No. 6,779,542, which is a divisional patent application of U.S. patent application Ser. No. 09/981,103 filed on Oct. 17, 2001, now U.S. Pat. No. 6,581,639, by G. Fiala et al. which claims benefit under 35 U.S.C. § 119(e) of U.S. Provisional Patent Application No. 60/241,911, filed Oct. 20, 2000, the full disclosures of which are hereby incorporated by reference.

FIELD OF THE INVENTION

The invention relates generally to hydraulic controls for regulating the flow of hydraulic fluid to hydraulic actuators. More particularly, it relates to spool valves for regulating such flow.

BACKGROUND OF THE INVENTION

Hydraulic valves for controlling the movement and position of hydraulic actuators that are connected to large loads usually include several hydraulic circuit protection devices necessary to prevent damage to the hydraulic system, either the actuator or the hydraulic valves themselves. The two primary problems faced by hydraulic systems are that a sudden impact on the actuator or a sudden application of high pressure hydraulic fluid may lead to a large high pressure pulse in hydraulic components that are not sized to handle these high pressure pulses. To cure this problem, hydraulic controls and particularly spool valves that are commonly used to regulate hydraulic flow are equipped with an over-pressure relief circuit that dumps excess pressure back to the hydraulic tank, which is at a substantially lower pressure than the hydraulic supply pressure. Typical tank pressures range from 0 to 100 psi, where typical supply pressures may range from 500 to 4,000 psi. The relief valve, by opening, permits fluid pressure applied to the actuator to be automatically reduced. Once the pressure is within the proper range, typically 100 to 800 psi, these over-pressure relief valves automatically close.

Another problem faced by hydraulic systems is the formation of a vacuum in hydraulic lines. Just as hydraulic over-pressure can damage hydraulic systems by bursting actuators, valves and conduits, a vacuum in a hydraulic line can cause the hydraulic fluid to vaporize. These vapor bubbles in themselves are not damaging. When the pressure is increased, however, these bubbles collapse upon themselves as the hydraulic vapor condenses. There are substantial local transient pressure waves produced. Pressure waves formed by the collapsing bubbles will, over time, damage and dangerously weaken the hydraulic components in the system. This problem is called "cavitation".

For this reason, hydraulic controls, and particularly hydraulic spool valves and valve bodies, are provided with "anti-cavitation valves". These valves operate in a somewhat similar fashion to over-pressure relief valves. In a sense, anti-cavitation valves are under-pressure relief valves. When a hydraulic pressure drops below tank (or "return") pressure, the anti-cavitation valves automatically open and permit the flow of hydraulic fluid into the low pressure regions, thus preventing the formation of hydraulic vapor bubbles. When the under-pressure condition is relieved, the anti-cavitation valves automatically close, thereby cutting off additional hydraulic flow.

Another common feature in hydraulic controls, spool valves and valve bodies is the hydraulic check valve. A check valve is one that permits the flow of fluid in one direction only. These valves are typically disposed between a manually or electrically actuated spool (that direct flow to an actuator) and the actuator itself. Check valves relieve the pressure differential that would otherwise remain on the spool at all times. Without the check valve, sudden over-pressure conditions in the actuator would be instantly transmitted backwards to the control valve that regulates flow to or from the cylinder. These sudden pressure pulses can cause the control valve (the directional spool valve) damage. In addition, the check valves reduce leakage that would otherwise occur if the actuator pressure was maintained on the spool.

In prior art spool valves, these three valves: check valve, anti-cavitation valve and over-pressure relief valve, typically required that three different openings be drilled into the valve body, one for each valve. This required extensive machining. Typically, the valve body was drilled at three different locations.

What is needed, therefore, is a new check valve, over-pressure relief valve, and anti-cavitation valve arrangement that reduces the required or typical number of holes in a valve body. It is an object of this invention to provide such a valve arrangement.

SUMMARY OF THE INVENTION

In accordance with the first embodiment of the invention, a unitary insert for a cavity in a valve body is disclosed that includes a check valve, an anti-cavitation valve, and a pressure relief valve. The insert may have a longitudinal axis, a first end and a second end, and the first end may include a circular sealing surface coaxial with the longitudinal axis and configured to engage a mating coaxial circular sealing surface defined on an inner surface of the valve body cavity. The anti-cavitation valve may also include a first pair of coaxial mating surfaces defining therebetween a first flow path that opens under cavitation conditions. The pressure relief valve may include a second pair of coaxial mating surfaces that define therebetween a second flow path that opens under over-pressure conditions. The anti-cavitation valve may include an anti-cavitation spring disposed to bias the first pair of mating surfaces together. The pressure relief valve may include a relief spring disposed to bias the second pair of mating surfaces together. The first and second springs may be coaxial.

In accordance with the second embodiment of the invention, a valve for directing the flow of fluid both to and from a hydraulic actuator is disclosed including: a valve body having a first cavity configured to receive a valve insert, the first cavity having a cylindrical inner surface and a bottom; an insert disposed in the first cavity, the insert including an anti-cavitation valve, a check valve and a pressure relief valve; and a spool disposed in the valve body and configured to direct the flow of hydraulic fluid both from a source of hydraulic supply to an outlet port, and from the outlet port to a hydraulic tank. The insert may be disposed within the valve body to move axially within the cavity, and by such motion to function as the check valve. The insert may include a shell and a valve assembly inside the shell, wherein the valve assembly is disposed to move axially with respect to the shell, and by such motion to reduce cavitation at the outlet. The valve assembly may include a poppet and a poppet seat, and the poppet may be disposed to move with respect to the poppet seat to function as the pressure relief valve. The anti-cavitation valve may include a first seat disposed on an inner surface of the insert body and a second seat disposed on an annular ring of a valve assembly disposed within the insert body and configured to seal against the first seat. The valve assembly may include a poppet having a third seat wherein the annular ring has a fourth seat and the third and fourth seats are disposed to seal against each other. A first spring may be provided to move the insert axially to function as a check valve. The valve may also include a second spring disposed within the insert body to move the valve assembly axially within the insert body such that the first and second seats are sealed against each other. The valve assembly may also include a third spring disposed to bias the poppet's third seat against the annular ring's fourth seat.

In accordance with the third embodiment of the invention, a bi-directional hydraulic flow control valve that is couplable to a supply of pressurized hydraulic fluid and a hydraulic drain or tank, includes: a valve body with an elongate opening, two cavities, and two outlet ports; a valve spool with a plurality of lands positioned within the elongate opening and fluidly communicating with the first and second outlet ports and the hydraulic supply and the tank, such that axially moving the spool from a first neutral position to a first fill position will direct a flow of hydraulic fluid from the first outlet port to the tank and from the hydraulic supply to the second output port, and further where moving the spool from the neutral position to a second fill position will direct the flow from the hydraulic supply to the first outlet port and from the second outlet port to the tank; a first insert disposed in the first cavity and in fluid communication with the first outlet port, the first insert including a check valve, an anti-cavitation valve and a pressure relief valve; and a second insert disposed in the second cavity and in fluid communication with the second outlet port, the second insert including a check valve, an anti-cavitation valve and a pressure relief valve. Each of the first and second inserts may include a hollow valve body having an internal valve assembly with a first pair of seats in a mutually sealing arrangement to prevent or permit the flow of sufficient hydraulic fluid to prevent cavitation in a cavitation condition, and a second pair of seats in a mutually sealing arrangement to prevent or permit the flow of sufficient fluid to relieve an over-pressure condition. The valve assemblies inside the hollow valve bodies may each include first and second springs configured to close the first and second pair of seats, respectively, when the respective cavitation condition and the over-pressure condition no longer exist. Each of the first and second inserts may include a check valve seat located on an outside surface of the insert that abuts and seals against a mating valve seat on an inner surface of the first and second cavities, respectively. The valve may also include first and second check valve biasing springs abutting the first and second inserts, respectively, to bias the check valves of the first and second inserts closed. The first and second inserts may be disposed in flow paths between the first and second outlet ports and the spool to check hydraulic fluid from flowing backwards from the two outlet ports to the spool when the spool is in the neutral position.

DETAILED DESCRIPTION OF THE PREFERRED EMBODIMENT

Figure 1:
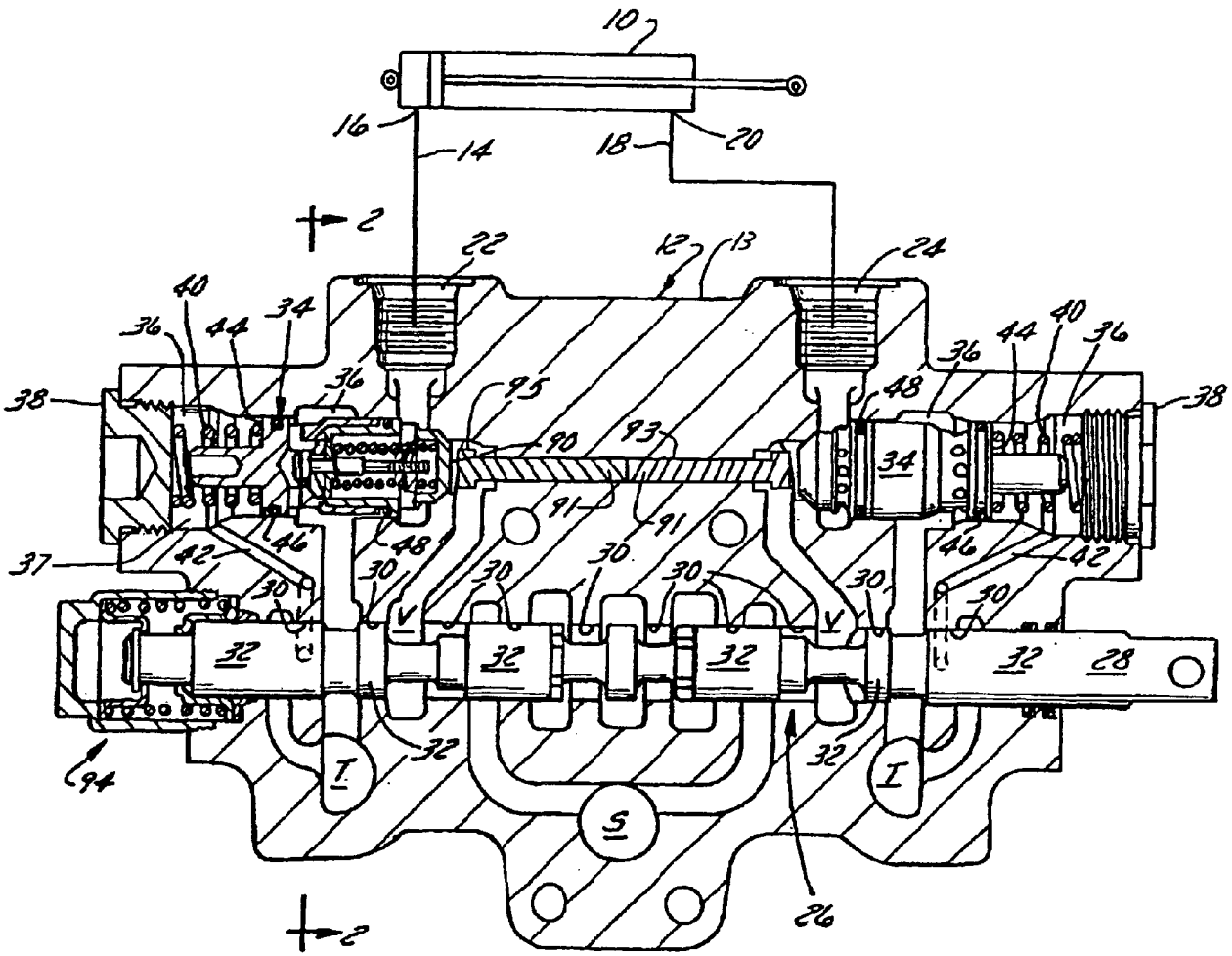
FIG. 1 shows a first embodiment of the invention including a monolithic valve body with a directional spool valve and two combined check, pressure relief and anti-cavitation valve cartridges (or "inserts")
Figure 2:
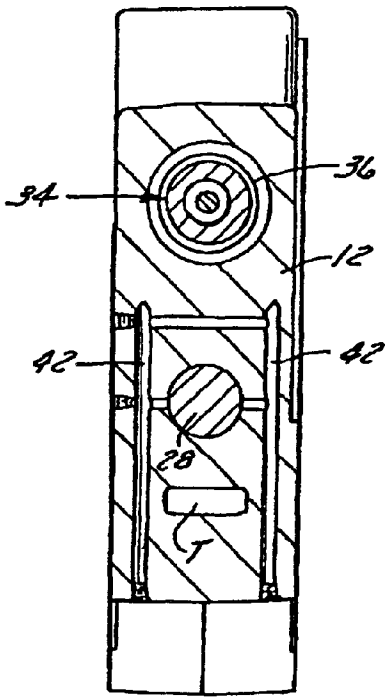
FIG. 2 is a cross-section through the valve body of FIG. 1 taken at section line 2—2 and showing details of the pressure relief passageways.

Referring now to FIGS. 1 and 2, a double acting hydraulic actuator 10 is shown coupled to and in flow communication with hydraulic valve 12. Actuator 10 is shown here as a hydraulic cylinder with a movable piston and piston rod. When hydraulic fluid is channeled through valve 12 to hydraulic line 14 and into port 16 of the cylinder, the piston and rod move leftward extending the length of the actuator. When hydraulic fluid is directed through hydraulic passageway 18 to port 20 of the cylinder, the piston and rod retract within the cylinder, thus reducing the overall length of the actuator.

Valve 12 includes two outlet ports 22 and 24 through which hydraulic fluid is coupled to hydraulic lines 14 and 18 respectively. These ports are threaded and accept mating hydraulic connectors that are well known in the art.

Valve 12 also includes a directional control valve 26 comprised of a spool 28 and a plurality of mating cylindrical lands 30. These lands support spool 28 and permit it to travel leftward and rightward (as shown in the drawing). This leftward and rightward motion of spool 28 causes cylindrical mating surfaces 32 to engage and disengage with lands 30 according to their size and spacing to direct flow to and from ports 22 and 24.

In the spool positions shown in FIG. 1, the spool is in a "neutral" position in which the spool blocks hydraulic fluid flow both to and from ports 22 and 24 and the hydraulic tank and/or supply. At the bottom of FIG. 1 there are passageways identified with the letter "T". This indicates that these passageways are connected to hydraulic return tank (not shown). The hydraulic tank is under low or no pressure (typically 0 to 100 psi) as compared to the supply pressure, which is indicated by the letter "S" in FIG. 1. A source of hydraulic fluid under pressure is connected to the passageways indicated with the letter "S". This source forms no part of the invention and thus, has not been shown.

Directional control valve 26 simultaneously controls the flow of fluid to and from both of ports 22 and 24. When spool 28 of directional control valve 26 is shifted to the left, as shown in FIG. 1, the hydraulic supply connected to passageway "S" is in fluid communication with fluid port 24 and the hydraulic tank connected to passageway "T" is in fluid communication with port 22. Since these two ports are in fluid communication with extension port 16 and retraction port 20 of actuator 10 via hydraulic lines 14 and 18, respectively, shifting the spool to the left causes the actuator to retract as fluid is exhausted from port 16 and returned to tank and as fluid simultaneously fills port 20 of actuator 10.

In a similar fashion, when spool 28 of valve 26 is shifted to the right, the opposite flows and actuator motions occur. Note that the spool in this embodiment is symmetric about its middle, and therefore, when one port is filled, the other port is emptied and vice-versa. When spool 28 is shifted to the left, port 24 of valve 12 is connected to tank "T" and port 22 of valve 12 is connected to supply "S". This causes flow of hydraulic fluid from port 22 to extension port 16 of actuator 10 and causes fluid flow from retraction port 20 of actuator 10 to tank "T". When spool 28 is shifted to the right, actuator 10 extends.

Note that the passageways are also mirror images of each other along a vertical centerline of the valve 12 (FIG. 1). This bi-directional symmetrical relationship of valve 12 means that the operation of the valve on either side, and therefore for either of ports 22 and 24, is always its reverse of the operation on the other side of the valve.

Due to this symmetry, we limit our description of the operation of cartridges 34 to only the left-hand cartridge shown in FIG. 1. All of the functions and operations of the left hand cartridge in FIG. 1 and the left hand portion of the spool in FIG. 1 are identical to the functions and operations of the right hand cartridge and right hand spool shown in FIG. 1. Thus, while the description below is limited to the left-hand side of valve 12, it is equally true for the right hand side as well.

Valve 12 includes two cartridges or inserts 34 through which hydraulic fluid passes on its way to ports 22 and 24 from valve 26 and on its way back to valve 26 when it returns from ports 22 and 24. These cartridges include internal valves that provided the anti-cavitation and pressure relief features of the present invention. Furthermore, each of the cartridges has a circular external seat, preferably conical, that mates with a similar seat formed in the cavity 36 that receives the cartridge. Once cartridges 34 have been inserted into their respective cavities 36, a threaded end cap 38 is screwed into the opening of cavity 36 to seal a cartridge in place and prevent the leakage of hydraulic fluid. Depending on the particular application for which the valve is intended, a spring 40 may be disposed between the cartridge and the end cap to bias the sealing surface on the outside of the cartridge against the sealing surface on the inside of cavity 36. These surfaces define the check valve function.

Figure 12:
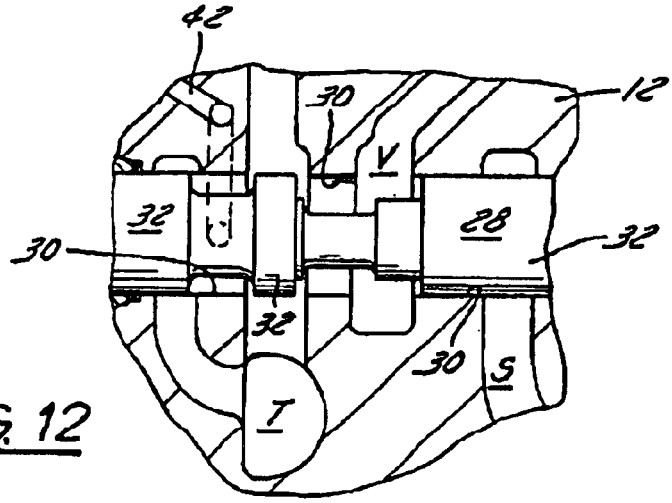

A hydraulic pressure relief passageway 42 is provided in the valve body that couples the backside of the cartridge 44 with an opening in a land 30 that abuts spool 28. Details of the construction of this passageway can be seen in more detail in FIG. 2. In this manner, when spool 28 moves to the left, as shown in FIG. 12, the backside 44 of cartridge 34 is in fluid communication with the tank, and effectively at tank pressure. When spool 28 is in a neutral position, this passageway is closed off. Similarly, when the spool is shifted to the right, such that fluid flow is conducted from the supply to port 22, this passageway 42 is also closed off.

Figure 3:
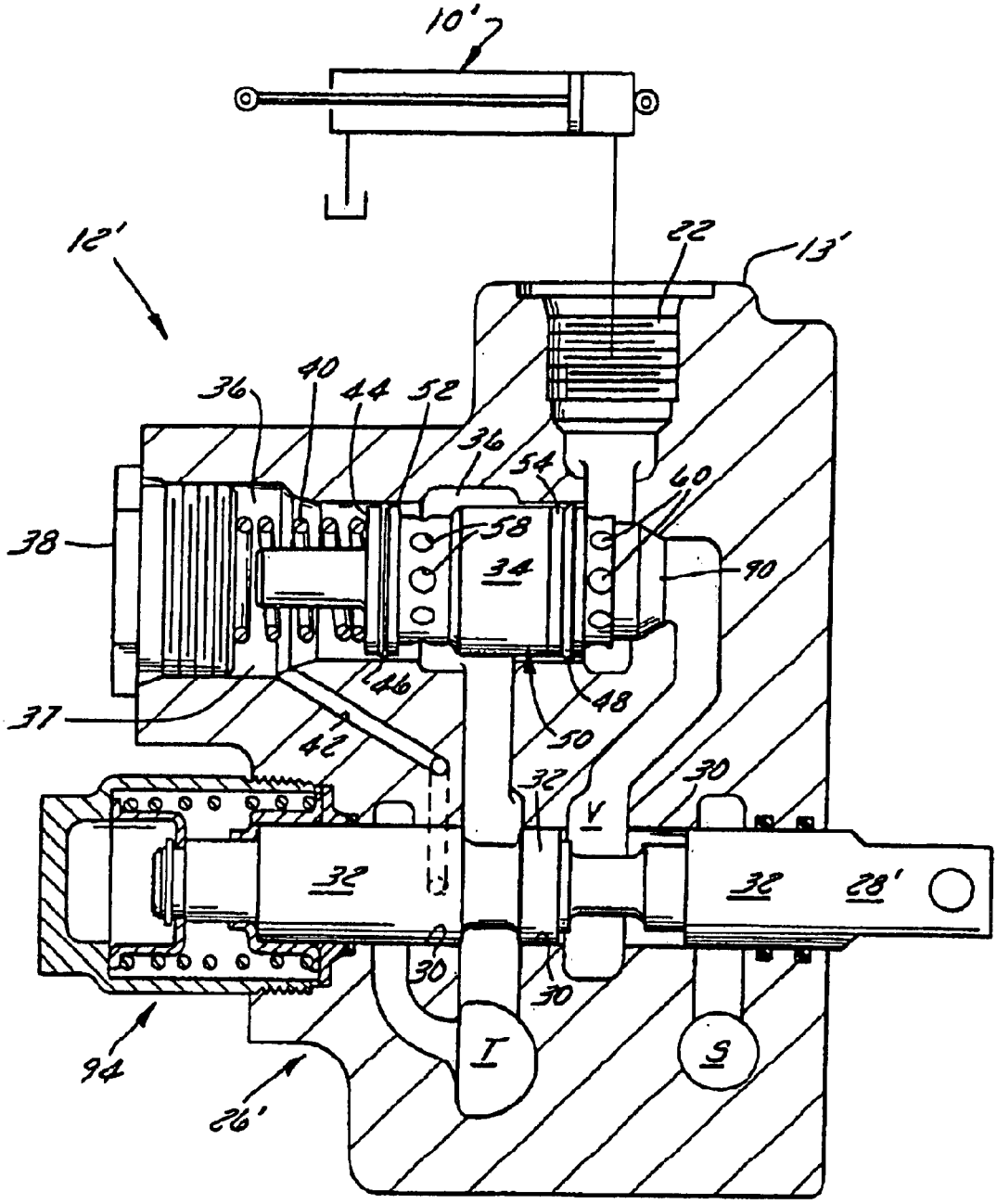
FIG. 3 is a cross-section through a valve body including a directional spool valve and a single combined valve cartridge identical to that of FIG. 1 for bi-directionally controlling the flow to a single port on a hydraulic actuator.

Referring now to FIG. 3, we can see a single-acting valve 12' similar to the valve illustrated in FIG. 1. The difference between this valve and the valve of FIG. 1 is that there is only a single cartridge 34 disposed in the valve body and a single port 22. In addition, the spool 28' is configured to direct flow to and from cartridge 34 in port 22, and lacks similar features to control two ports such as spool 28 in FIG. 1. In effect, the valve 12' shown in FIG. 3 is identical to the left hand portion of valve 12 shown in FIG. 1 and to the right-hand side of valve 12 has been removed. Since valve 12' in FIG. 3 only has a single port 22, it is appropriate for use with single acting cylinders such as cylinder 10' to which port 22 is coupled.

A single-acting valve 12' would be appropriate where bi-directional hydraulic force need not be applied to an actuator in order to control both its extension and retraction. A typical case might be for a boom lift cylinder in a backhoe, for example, or for a hydraulic car jack. In both these cases, the motion of an actuator, both in extension and retraction, can be controlled simply by applying pressurized fluid to one side of a piston or removing such pressurized fluid from that side of a piston. In all other respects, other than its lack in symmetry, valve 12' is identical to valve 12 in FIG. 1.

Figure 4:
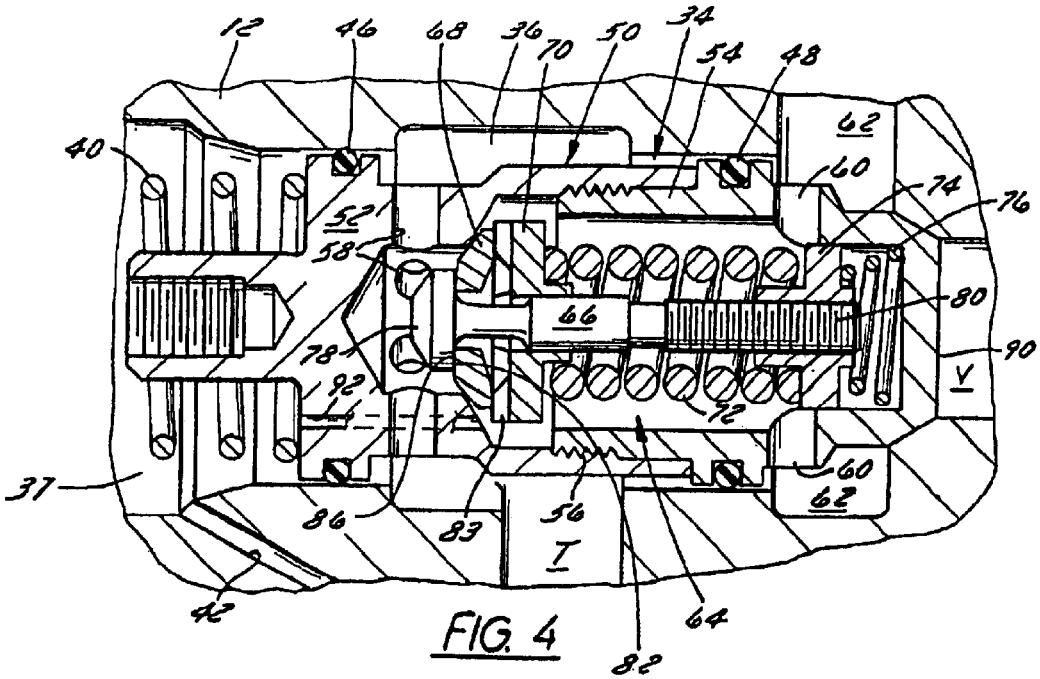
FIG. 4 is a fragmentary cross-sectional view of the valve cartridge in both of FIGS. 1 and 3 showing the inner details and construction of the cartridge more clearly.

FIG. 4 is a cross-sectional view of cartridge 34 in cross-section. The cartridge is supported inside cavity 36 by two sealing rings 46, 48. Sealing ring 46 is disposed in a circumferential groove on the outer surface of cartridge 34 towards the outer end of cartridge 34. Sealing ring 48 is similarly disposed in a circumferential groove on an inner end of cartridge 34.

The body 50 of cartridge 34 forms substantially the entire outer surface of the cartridge. It is formed of two cup-shaped shells 52, 54. Shell 52 is disposed at and forms the outer end of the cartridge and shell 54 is disposed at and forms the inner end of the cartridge. The shells have mating threads 56 by which they are threadedly connected. Shells 52, 54 have a plurality of passageways 58, 60, respectively, that provide fluid communication from the interior of each shell to the exterior of that shell. Passageways 58 are disposed in shell 52 and open onto the outside of the shell between sealing rings 46 and 48. Passageways 58 are in constant fluid communication with annular groove 62 that, as best seen in FIGS. 1 and 3, and are therefore, in constant fluid communication with the tank passageway "T". Thus, regardless of the lateral position of cartridge 34 within cavity 36, the central cylindrical outer surface portion end of cartridge 34 between rings 46 and 48 is always substantially at tank pressure.

Figure 5:
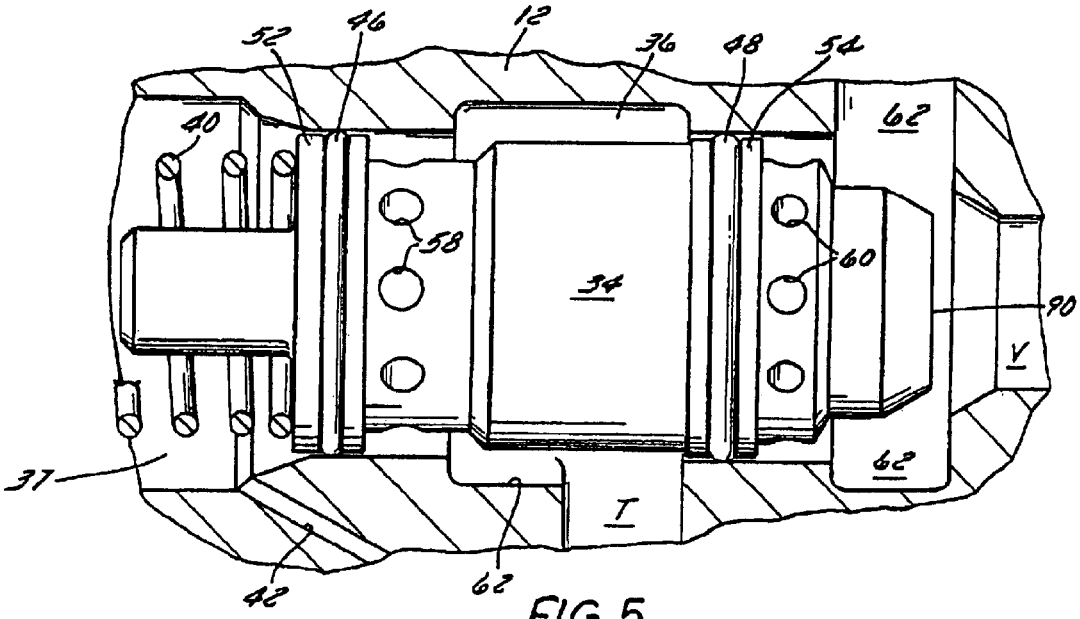
FIG. 5 is a fragmentary cross-section of the valve bodies of FIGS. 1 and 3 showing the position of any of the valve cartridges in those FIGURES in the position the cartridges will assume when the directional spool valve is directing fluid to the cartridge and actuator from the supply.

Passageways 60 are formed at the right end of the cartridge and provide fluid communication between the inside of shell 54 and the outer surface of the cartridge. As best seen in FIG. 5, passageways 60 are disposed outside of sealing rings 46 and 48. Passageways 60 are in constant fluid communication with chamber 62, which in turn is in constant fluid communication with port 22. Thus, the right-hand inside end of shell 58 is always at substantially the same fluid pressure as the pressure at port 22, and hence the pressure in actuator 10 (FIG. 1) or 10' (FIG. 3).

We can see, therefore, that no matter the lateral position of cartridge 34, its interior is divided into two chambers, each chamber is at a different pressure: the left-most region at tank pressure and the right-most region at actuator pressure. Clearly, if there is no barrier between these two regions, there would be no way to move the actuator. Any fluid directed toward actuator 10 by cartridge 34's operation as a check valve would immediately exhaust to the tank.

Referring to FIG. 4, this barrier is shown as valve assembly 64. This assembly acts not only as a barrier for free flow through cartridge 34 from actuator to tank but also provides the anti-cavitation and pressure relief functions of the cartridge. Valve assembly 64 includes a poppet 66 that extends substantially the entire length of assembly 64, an annular ring 68, a spring guide 70, an over-pressure relief spring 72, a spring adjustment stop 74 and an anti-cavitation spring 76. All these components are substantially circular and co-axial.

Poppet 66 has a head 78 on one end and a threaded end portion 80 at the other. Annular ring 68 includes two sealing surfaces 82, 84. It is preferably symmetric in shape about its longitudinal axis. Sealing surface 82 abuts a mating sealing surface 86 on the inside surface of poppet 66. Sealing surfaces 82 and 86 act as a first barrier preventing the flow of fluid from one side of valve assembly 64 to the other. Sealing surface 84 of ring 68 is configured to abut and seal against sealing surface 88 of shell 52. Sealing surfaces 84 and 88 are likewise circular and act as a barrier preventing flow from the right-hand chamber of cartridge 34 (at actuator pressure) to the left-hand chamber of cartridge 34 (at tank pressure).

There are therefore a total of four concentric sealing surfaces inside cartridge 34 that prevent fluid flow from the one interior region of the cartridge to the other. It is these sealing surfaces that open and close to provide concentric circular gaps under anti-cavitation and over-pressure conditions as described below.

Spring 72 holds sealing surfaces 82 and 86 together. Spring 76 holds sealing surfaces 84 and 88 together. One end of spring 72, the left-most end in the figures herein, applies a force to guide 70, which, in turn, presses against seat 68. The right-most end of spring 72 presses against spring stop 74 which is threaded onto the right-most end of poppet 66. By varying the amount of threaded engagement between stop 74 and the right-most threaded portion of poppet 66, the amount spring 72 preload compression can be varied. This permits one to vary the force that holds sealing surfaces 82 and 86 together.

Figure 7:
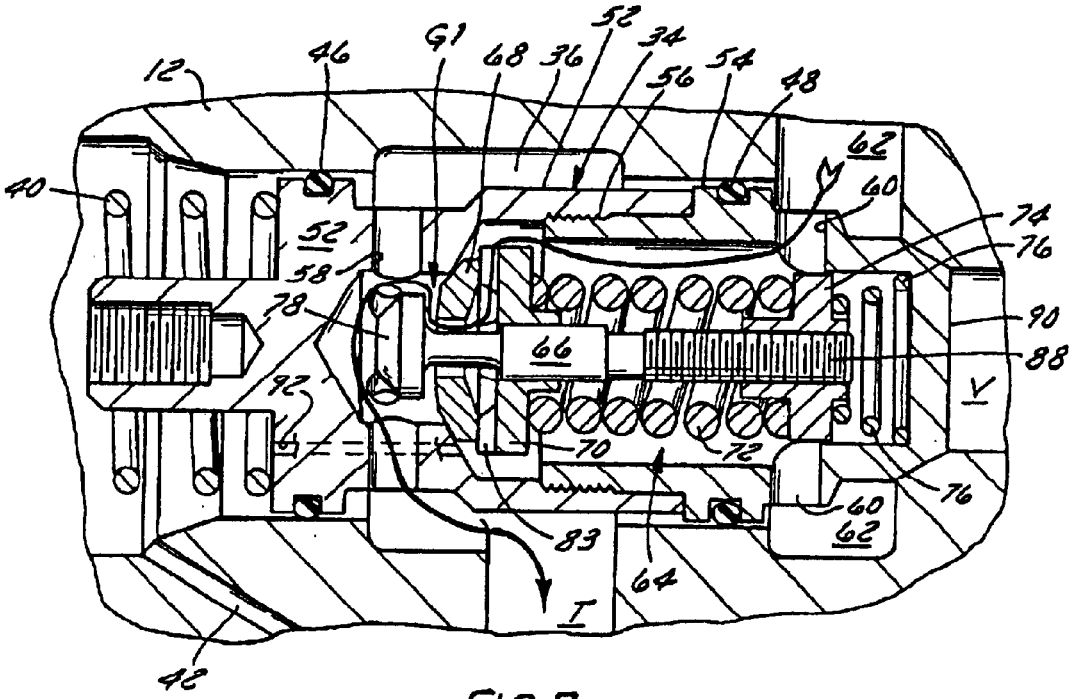
FIG. 7 is a fragmentary cross-section of the valve bodies and cartridges of FIGS. 1 and 3 showing the internal components of the cartridges in the position they will assume when the cartridge is operating in an over-pressure relief mode.
Figure 8:
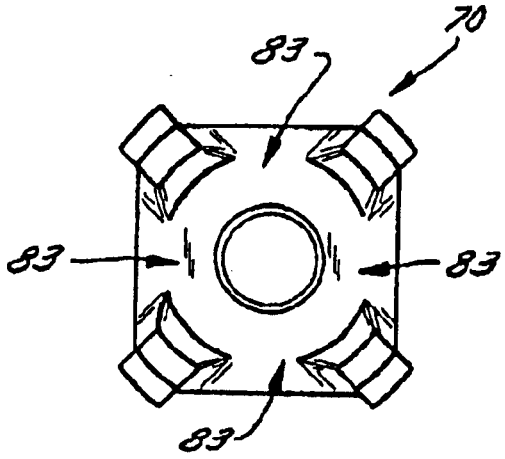
FIGS. 8 and 9 are plan and side views, respectively, of the spacer used in the valve cartridges of all the preceding FIGURES.
Figure 9:
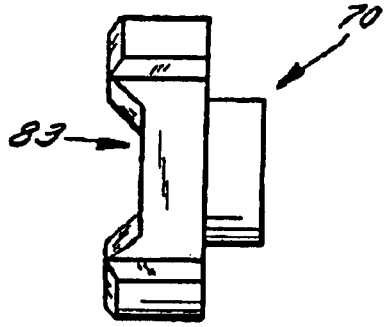
Figure 10:
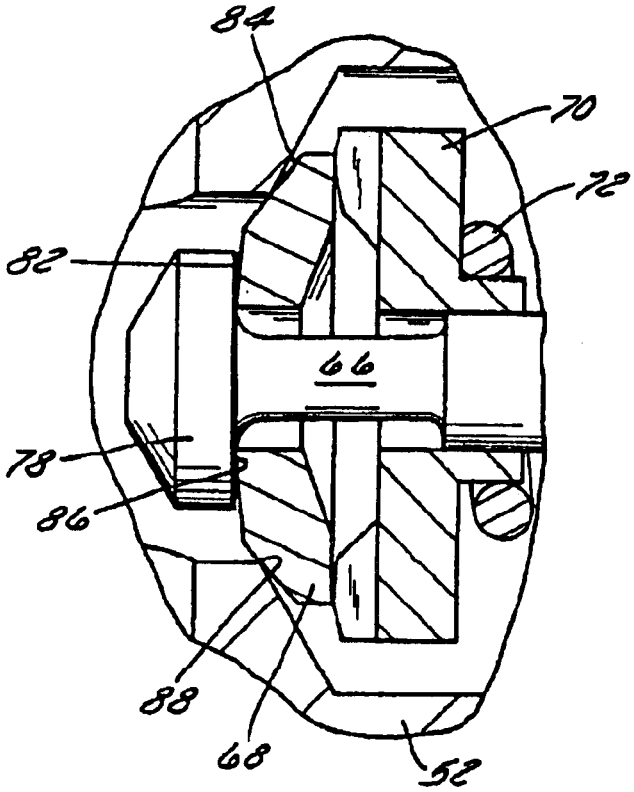
FIG. 10 is a fragmentary cross-section of the cartridges of any of the preceding views showing the spacer and its associated components in greater detail.

Referring to FIG. 4, as fluid pressure in port 22 (and hence actuator 10) increases, the pressure in the right hand chamber inside cartridge 34 also increases. When this pressure reaches and over-pressure condition, it is sufficient to overcome the force holding seat 82 against seat 86 through annular gaps "G1" (FIG. 7). This position is shown in FIG. 7 where fluid flow is shown passing around notches 83 in spring guide 70 on its way from actuator towards tank "T." At this point, poppet 66 moves to the left with respect to the cartridge body, and fluid is permitted to escape between sealing surfaces 82 and 86. The cartridge itself does not change position during this process. It remains stationary. Only the internal components move with respect to each other. In a similar fashion, spring 76 presses against the entire valve assembly 64 and pushes it such that sealing surface 84 on ring 68 is pressed against sealing surface 88 on the left hand shell of the insert. When an under-pressure condition occurs, a condition likely to cause cavitation, these two sealing surfaces open up to permit fluid to flow from the tank passageway "T" toward port 22 to relieve the under-pressure condition.

Figure 6:
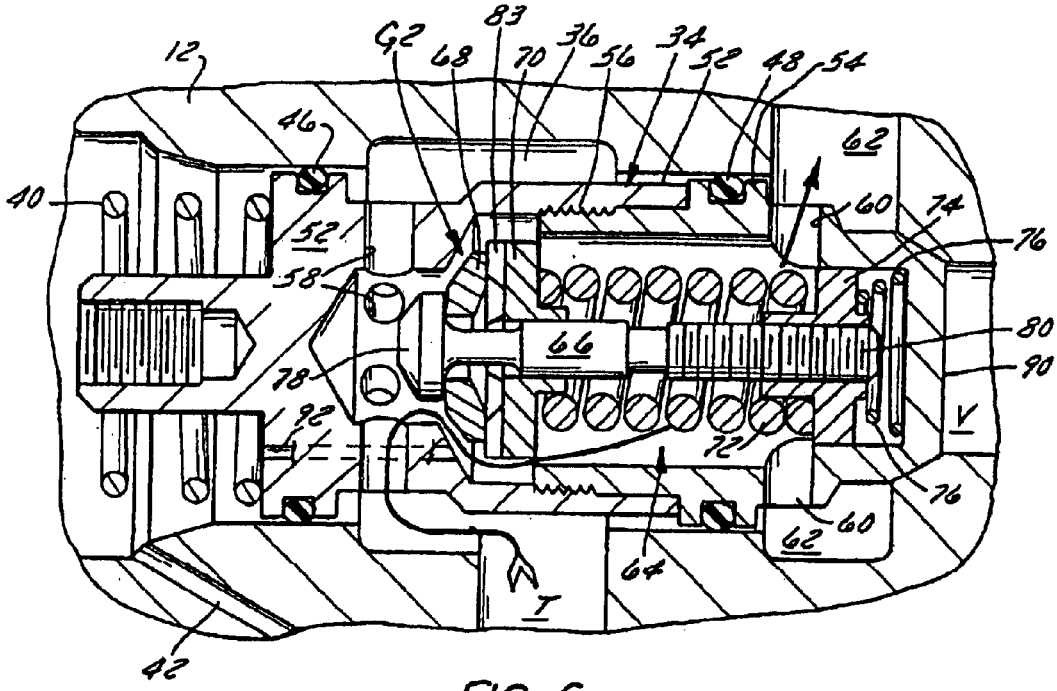
FIG. 6 is a fragmentary cross-sectional view of the valve body and cartridges of FIGS. 1 and 3 showing the position of the components in the valve cartridges when they are operating in an anti-cavitation mode.

As the pressure in actuator 10 (and hence port 22) drops, there is a point at which tank pressure pressing against the head 78 and seat 68 on the left hand end of the insert is sufficient to move the entire valve assembly rightwardly compressing spring 76 (see FIG. 6). This rightward movement of all of valve assembly 66 causes an annular gap, "G2", (FIG. 6) to appear between sealing surface 84 on ring 68 and sealing surface 88 on the inside of shell 52. As a result, fluid under tank pressure can flow into the insert, through the insert, and towards port 22 as shown by the arrow in FIG. 6. This fluid flow will continue as long as the under-pressure condition in the region of port 22 persists.

Once the pressure in port 22 has risen sufficiently, spring 76 will force seat 68 back against annular sealing surface 88 of shell 52 and the flow will be cut off (see position in FIG. 4).

Figure 13:
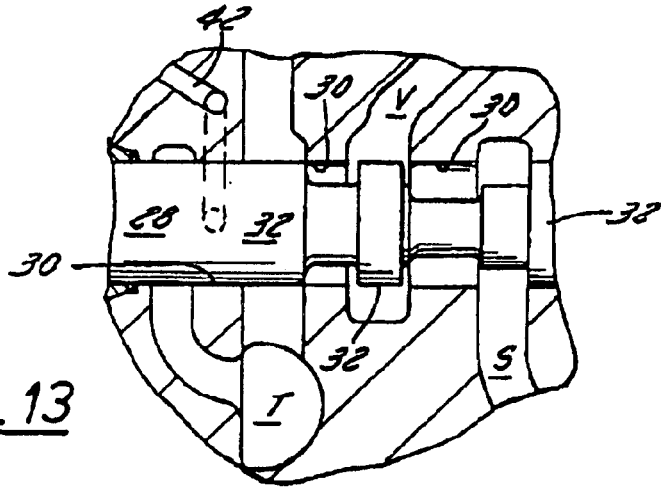

We have described above how the cartridge operates as a pressure relief valve and as an anti-cavitation valve by the relative motion of the cartridge's internal components. The final mode of operation is the check valve mode, which we now describe. FIG. 5 illustrates the position of cartridge 34 when valve 26 sends fluid toward port 22. In order to send fluid from the supply toward port 22 to fill actuator 10, spool 28 is moved to the right from the neutral position shown in FIG. 11 to the rightwardly deflected position shown in FIG. 13. This motion opens a path for fluid flow from the hydraulic supply "S" to a line "V" that extends from spool 28 to the rightmost end of cartridge 34. Fluid pressure at supply pressure is therefore applied to the end face 90 of cartridge 34. This causes a net force in balance on the entire insert and the insert moves to the left compressing spring 40. The insert during this motion is preferably supported on sealing rings 46 and 48 that prevent the flow of fluid from the rightmost end to the leftmost end.

The pressure applied to the leftmost end of cartridge 34 is substantially equal to the actuator pressure. A fluid flow passageway 92 shown in FIG. 4 permits fluid to flow from the interior of cartridge 34 to leftmost end of cartridge 34. This passageway is coupled to the interior of the insert such that it communicates with the pressure at port 22. This is substantially the same as the pressure in actuator 10 and the pressure in passageway 62 shown in FIG. 4. As a result, cartridge 34 will always move to the left as shown in FIG. 5 as long as the supply pressure is greater than the pressure in the actuator.

Figure 11:
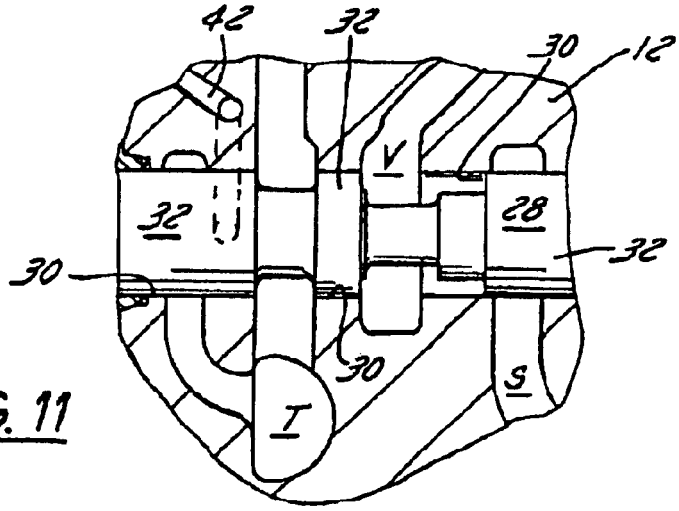
FIGS. 11–13 are fragmentary cross-sections of the directional spool valves shown in FIGS. 1 and 3 indicating how they are moved to control the flow of hydraulic fluid from the hydraulic supply and to the tank in (a) a neutral (no flow) position) (FIG. 1), in (b) an empty position in which the actuator is empty of hydraulic fluid (FIG. 12), and in (c) a fill position in which spool valve directs a flow of pressurized hydraulic fluid from the supply "S" to its associated cartridge and thence to the actuator.

Once actuator 10 has moved the appropriate amount, the operator releases spool valve 28 and returns to the neutral position shown in FIG. 11. This return to a neutral position is provided by the spring and flange assembly 94 located at the left end of valve 12 (FIG. 1). When spool 28 returns to the neutral position of FIG. 11, flow from supply "S" to passageway "V" is blocked off and interrupted. As a result, the force applied to the right end face 90 of cartridge 34 drops. The pressure in region 62 around the right end of cartridge 34 rapidly drops to the internal pressure at port 22 and hence in the pressure inside actuator 10. This pressure, as we described above is also applied to the left end of cartridge 34. As a result, fluid pressures on both ends of cartridge 34 are equal and there is a fluid force balance. Spring 40, however, exerts a force on the left end of cartridge 34 and therefore moves cartridge 34 rightwardly from the position shown in FIG. 5 to the position shown in FIG. 4. This closes off fluid communication between port 22 and spool 28. The above is how cartridge 34 operates as a check valve.

Fluid is moved from actuator 10 through port 22 and back to the tank in the following manner. First, the spool is in a neutral position shown in FIG. 11. In order to connect port 22 to tank, the operator moves spool 28 leftwardly as shown in FIG. 12. In this position, the supply is blocked off and cannot flow to passageway "V", which leads to the right-most end 90 of cartridge 34. Instead, passageway "V" is fluidly connected to the tank passageway "T" as shown in FIG. 12. As a result, the pressure applied to end face 90 of cartridge 34 drops from tank pressure to actuator pressure.

In addition, however, the pressure on the left-most end of cartridge 34 also drops to tank pressure. Note in FIG. 12 that the leftward motion of spool 28 also connect passageway 42 to tank pressure. In FIG. 11, the neutral position, passageway 42 is blocked off by a portion of spool 28. Similarly, in FIG. 13, when spool 28 is moved rightwardly in order to send fluid from supply "S" to port 22, described above, passageway 42 is also blocked off by spool 28. In FIG. 12, however, when spool 28 is moved leftwardly to connect passageway "V" acting on which conducts fluid to or from the end face 90 of cartridge 34, passageway 42 is connected to tank as well.

As a result, and referring back to FIG. 4, the pressure on the left end of cartridge 34 drops to tank pressure as fluid is conducted through passageway 42 to tank "T". The pressure on end face 90 on the right end of cartridge 34 also drops to tank pressure. Thus, spring 40 exerts a rightward force on cartridge 34, and the actuator pressure, which is communicated to chamber 62 exerts a leftward force on cartridge 34. Spring 40 is selected such that it will not overcome the force provided by the actuator pressure in chamber 62 and the whole spool shifts to the left as shown in FIG. 5. This movement fluidly couples passageway 62 and passageway "V". Since passageway "V" is connected to tank, fluid is permitted to flow from actuator 10 through port 22 through chamber 62 through passageway "V" and then to the tank. Once the actuator pressure drops to tank pressure, the force balance on cartridge 34 will be changed and spring 40 will again move cartridge 34 rightwardly until passageway "V" and passageway 62 are blocked off. Alternatively, if at any time during this emptying process the operator moves spool 28 from the empty position shown in FIG. 12 to the neutral position shown in FIG. 11, the emptying process will also stop. When the operator moves spool 28 from the position in FIG. 12 to that of FIG. 11, the communication between passageway "V" and the tank "T" is cut off by spool 28. Furthermore, passageway 42 is blocked off preventing flow from the left end of cartridge 34 to the tank. As a result of the these two changes, actuator pressure builds up on the left end of cartridge 34 as well as the right end of cartridge 34 leading to a fluid force balance. With this fluid force balance, the force applied by spring 40 is again able to move cartridge 34 rightwardly until passageway 62 and passageway "V" are again blocked off.

What is claimed is:

1. A valve for directing the flow of fluid both to and from a hydraulic actuator, the valve comprising:

a valve body having a first cavity configured to receive a valve insert, the first cavity having a cylindrical inner surface and a bottom, the valve including a spool disposed in the valve body and configured to direct the flow of hydraulic fluid both from a source of hydraulic supply to an outlet port and from the outlet port to a hydraulic tank; and an insert disposed in the first cavity, the insert including an anti-cavitation valve, a check valve and a pressure relief valves, wherein the insert is disposed within the valve body to move axially within the cavity, and by such motion to function as the check valve and includes a shell and a valve assembly inside the shell, wherein the valve assembly is disposed to move axially with respect to the shell, and by such motion to reduce cavitation at the outlet port, wherein the valve assembly includes a poppet and a poppet seat, and further wherein the poppet is disposed to move with respect to the poppet seat to function as the pressure relief valve, and wherein the anti-cavitation valve includes a first seat disposed on an inner surface of the insert body and a second seat disposed on an annular ring of a valve assembly disposed within the insert body and configured to seal against the first seat.

2. The valve of claim 1, wherein the valve assembly includes a poppet having a third seat and wherein the annular ring has a fourth seat and further wherein the third and fourth seats are disposed to seal against each other.

3. The valve of claim 2 further including a first spring disposed to move the insert axially to function as a check valve.

4. The valve of claim 3, further including a second spring disposed within the insert body to move the valve assembly axially within the insert body such that the first and second seats are sealed against each other.

5. The valve of claim 4, wherein the valve assembly further comprises a third spring disposed to bias the poppet's third seat against the annular ring's fourth seat.

* * * * *